US007048769B1

(12) United States Patent
Weltrowski et al.

(10) Patent No.: US 7,048,769 B1
(45) Date of Patent: May 23, 2006

(54) FIBER WITH IMPROVED COMPLEXATION QUALITIES AND CATION-EXCHANGE PROPERTIES

(75) Inventors: Marek Weltrowski, Quebec (CA); Michel Morcellet, Villeneuve d'Ascq (FR); Bernard Martel, Lille (FR)

(73) Assignee: Universite des Sciences et Technologies de Lille, Villeneuve d'Ascq (FR)

( * ) Notice: Subject to any disclaimer, the term of this patent is extended or adjusted under 35 U.S.C. 154(b) by 0 days.

(21) Appl. No.: 09/913,448

(22) PCT Filed: Feb. 15, 2000

(86) PCT No.: PCT/FR00/00378

§ 371 (c)(1),
(2), (4) Date: Aug. 14, 2001

(87) PCT Pub. No.: WO00/47811

PCT Pub. Date: Aug. 17, 2000

(30) Foreign Application Priority Data

Feb. 15, 1999 (FR) ..... 99 01967

(51) Int. Cl.
*C11D 3/00* (2006.01)

(52) U.S. Cl. ..... 8/115.51; 8/115.6; 8/116.1

(58) Field of Classification Search ..... None
See application file for complete search history.

(56) References Cited

U.S. PATENT DOCUMENTS 5,728,823 A * 3/1998 Reuscher et al. ..... 536/46
2003/0035748 A1* 2/2003 Trinh et al. ..... 422/5

* cited by examiner

*Primary Examiner*—Jill Gray
(74) *Attorney, Agent, or Firm*—Weingarten, Schurgin, Gagnebin & Lebovici LLP

(57) ABSTRACT

The present invention concerns a process for treating a fiber or a fiber-based material such as a yarn, a woven, knitted or nonwoven textile material, paper, or leather, to improve its adsorption properties, wherein the following successive operations are carried out on said fiber or said material:

a) applying a solid mixture of cyclodextrin(s) and/or cyclodextrin derivative(s) and/or inclusion complex(es) of cyclodextrin and/or cyclodextrin derivatives, at least one poly(carboxylic) acid and/or at least one poly(carboxylic) acid anhydride and optionally a catalyst;
b) heating to a temperature in the range 150° C. to 220° C.;
c) washing with water; and
d) drying.

The present invention also concerns fibers or fiber-based materials with improved cation exchange properties and improved hydrophilic characteristics.

7 Claims, No Drawings

FIBER WITH IMPROVED COMPLEXATION QUALITIES AND CATION-EXCHANGE PROPERTIES

The present invention relates to a process for treating a fiber or a fiber-based material to improve its adsorption (complexing) properties. The present invention also relates to a fiber or fiber-based material, such as a textile, with improved adsorption properties.

BACKGROUND OF THE INVENTION

Improving the complexing properties of fibers allows different active compounds such as fragrances, insecticides, bactericidal agents, antistatic agents, anti-bacterial agents or repellent agents to be adsorbed onto a fiber or fiber-based material. Because the adsorbed active product subsequently diffuses into the surrounding atmosphere (release), the complexing phenomenon, which occurs in the fibers, endows the fiber or any material containing it with the different chemical properties of the adsorbed product for a set period that depends on the rate of diffusion of the complexed product (release rate).

One known method for improving the adsorbent properties of a fiber is fixing (grafting) molecules of cyclodextrin (s) onto the fiber.

Cyclodextrins (α-cyclodextrin, β-cyclodextrin and γ-cyclodextrin) have long been known to be molecules possessing complexing properties, i.e., molecules that are capable of reversibly trapping certain other small molecules of a hydrophobic nature, in particular aliphatic or aromatic molecules, from their solutions, vapors or solid mixtures. The adsorbed molecules are bonded to the cyclodextrin by the formation of inclusion complexes.

The release rate of the product complexed by cyclodextrins is small, so fibers functionalized by cyclodextrins are perfectly suited to produce fiber-based materials, in particular textiles, which possess the chemical properties of the complexed product in a stable manner and for long periods, and also to produce adsorbent materials. These adsorbent materials have a number of applications, in particular in water purification and contaminated gas purification.

Textile materials functionalized with cyclodextrins with adsorbed fragrances, antistatic agents, antimicrobial agents, insect repellents, bactericidal agents, or insecticides, have been respectively described in the following documents: Japanese patent JP-A-06-116871, U.S. Pat. No. 5,376,287, JP-A-09 315920, JP-A-04-263617, JP-A-09-228144, JP-A-05-311509, U.S. Pat. No. 5,670,456 and JP-A-03-59178.

Textile materials functionalized by cyclodextrins and with hygroscopic and odor adsorption properties have been described in JP-A-06-322670, JP-A-02-127573, JP-A-03-14678, JP-A-08-199478, JP-A-02-251681 and JP-A-163372.

Textiles functionalized with cyclodextrins and used as adsorbents, in particular as barriers to contaminants, have been described in U.S. Pat. No. 5,776,842.

These examples are not limiting. Potential applications for textiles functionalized with cyclodextrins have been cited by Denter and Schollmeyer in the document "Proceedings of the Eighth International Symposium on Cyclodextrins", Budapest, Hungary, 1996, J. Szejtli and L. Szente Eds, Kluwer Academic Publishers.

The principal technical difficulty in producing fibers and textiles functionalized by cyclodextrins or their inclusion complexes is to fix molecules of cyclodextrin(s) or their inclusion complexes onto fibers and textile materials in a durable manner. A number of fixing methods has been developed.

U.S. Pat. No. 4,357,468 describes a method for fixing cyclodextrin(s) using epichlorhydrin.

European patent EP-A-0 697 415, German patent DE-A-19520967 and Denter U., Schollmeyer E., J. Inclusion Phenom. Mol. Recognit. Chem. 25(1–3), 197–202 (1996) describe a method for fixing cyclodextrins using chlorinated heterocyclic compounds.

EP-A-0 488 294 and JP-A-03-59178 disclose a fixing method using reactive aminosiloxanes and siloxanes.

U.S. Pat. No. 5,098,793 describes polymers obtained by reacting cyclodextrin with an activated dicarboxylic acid. Such polymers form a film that adheres to the surface of a substrate that can be a cellulose substrate, for example. They do not contain any residual carboxylic acid functions because they come from dicarboxylic acid and since both of its carboxylic acid functions have been reacted.

JP-A-06-322670 describes a fixing method using a resin based on an aminosilicone and/or polyurethane.

JP-A-02—127573 describes a fixing method using a polymer (Hercosett 57) obtained by cross-linking a polyamide with epichlorhydrin.

JP-A-09-228144 describes a fixing method by incorporating cyclodextrins or their inclusion complexes into the chemical fiber spinning dope.

Finally, DE-A-4035378 describes a method for fixing cyclodextrin(s) or cyclodextrin derivative(s) using reactants carrying dimethylol urea groups or derivatives of such groups that react both with a hydroxyl group of the cyclodextrin and with a functional group of the fiber, bonding the cyclodextrin molecule to the fiber.

OBJECTS AND SUMMARY OF THE INVENTION

The present invention proposes a novel method for fixing cyclodextrin(s) or cyclodextrin derivative(s) that can fix molecules of cyclodextrin(s) or cyclodextrin derivative(s) in a durable manner to a fiber or a fiber based material such as a textile, regardless of the nature of the fiber or fiber-based material under consideration.

The present invention concerns a process for treating a fiber or a fiber-based material such as a yarn, a woven, knitted or nonwoven textile material, paper, leather, or a material based on wood fibers, to improve its adsorption properties, wherein the following successive operations are carried out on said fiber or said material: applying a solid mixture of cyclodextrin(s) and/or cyclodextrin derivative(s) and/or their inclusion complexes, at least one poly(carboxylic) acid and/or at least one poly(carboxylic) acid anhydride and optionally a catalyst, heating to a temperature in the range 150° C. to 220° C., washing with water and drying the product obtained.

The above inclusion complexes can, for example, be formed from an active agent complexed by a molecule of cyclodextrin or a cyclodextrin derivative. A material treated with an inclusion complex has a better guarantee of cyclodextrin complexing properties; the presence of a complexed agent retains accessibility to the cavity of the cyclodextrin.

The process of the present invention is of particular advantage in that it is applicable to any natural or artificial fiber and to any type of fiber-based material such as a textile material, paper or leather, which is capable of tolerating a heating step without undergoing either physical or chemical degradation. In particular, the process of the invention is applicable to fibers and to yarns composed of natural and artificial cellulose fibers, natural and artificial protein fibers, synthetic fibers such as polyesters, polyamides, acrylics, aramids, fluorofibers, or mineral fibers and to fiber-based materials and textiles of the woven, knitted or nonwoven type and containing one or more types of the above yarns and fibers.

The molecules of cyclodextrin(s) are fixed to the fiber or fiber-based material by two mechanisms that depend on the chemical nature of the fiber or the fiber-based material.

When treating fibers or materials composed of fibers comprising a hydroxyl and/or amine function, implementing the process of the invention initially forms an anhydride of the poly(carboxylic) acid that reacts with the fiber or fiber-based material by forming a covalent amide or ester type bond between the fiber or the fibers of the treated material and the poly(carboxylic) acid. Then, in the simplest case, a second poly(carboxylic) acid anhydride is formed bonded to the fiber; this reacts with a molecule of cyclodextrin or cyclodextrin derivative by creating an ester bond between the molecule of cyclodextrin or cyclodextrin derivative and that of the poly(carboxylic) acid. Possible formation of an anhydride from a further carboxyl function of the poly (carboxylic) acid bonded to the fiber then allows a reaction with a further molecule of cyclodextrin or cyclodextrin derivative. In that reaction, one or more molecules of cyclodextrin(s) or cyclodextrin derivative(s) is obtained bonded via an ester function to a molecule of poly(carboxylic) acid which is itself bonded to a fiber via a covalent bond.

Further, a second type of reaction may occur, either in parallel with or independently of the reaction fixing the cyclodextrin or cyclodextrin derivative to the fiber via a covalent bond. Because of the presence of poly(carboxylic) acid, a copolymer of cyclodextrin and/or cyclodextrin derivative(s) and/or their inclusion complexes with poly (carboxylic) acid(s) is formed; this copolymerization produces copolymers that are either linear, branched or cross-linked.

When the copolymer forms from a molecule of cyclodextrin fixed to the fiber via a covalent bond, it therefore has at least one covalent bond with a fiber. When the copolymer forms from molecules of poly(carboxylic) acid and/or poly (carboxylic) acid anhydride and cyclodextrin and/or cyclodextrin derivative(s) not bonded to a fiber, if it is cross-linked, i.e., forms a three-dimensional network mingling with or coating the fiber or the fibers of a fiber-based material, it may be mechanically fixed in a permanent manner to the fiber or material under consideration.

The basic mechanism using a molecule of poly(carboxylic) acid and a molecule of cyclodextrin or a cyclodextrin derivative is most probably similar to the mechanism for cross-linking cellulose with poly(carboxylic) acids in the presence of a catalyst proposed by Welsh C. M. in American Dyestuff Reporter 83(9), 19–26 (1994). Such a treatment, described in particular in U.S. Pat. No. 4,820,307 and carried out on cotton cellulose, renders cotton textiles crease-resistant by cross-linking cotton fibers. However, that process is intended to modify the physical properties of a textile material exclusively constituted by cellulose fibers, such as cotton, and not to modify the adsorption properties of a fiber or a fiber-based material by fixing cyclodextrin(s) or cyclodextrin derivative(s) to the fiber or to the structure of the fiber-based material, independently of the chemical nature of that fiber or material, as in the present invention.

Further, certain synthetic fibers or materials based on such fibers do not possess functional groups that can react with the mechanism proposed above. In this case, the cyclodextrin(s) and/or cyclodextrin derivative(s) and/or their inclusion complexes are fixed by forming a cross-linked copolymer obtained by exclusive reaction between the molecules of cyclodextrin(s) and/or cyclodextrin derivative(s) and at least one poly(carboxylic) acid. The cross-linked copolymer formed coats the fiber or the fiber-based material in a permanent manner.

In the case of a fiber comprising an amine or hydroxyl function, such as keratinous or cellulose fibers, or a material comprising such fibers, the two fixing mechanisms coexist, namely fixing via a covalent bond to the fiber and forming a sheath of cross-linked copolymer on the fiber.

The complexing properties of the cyclodextrins described above are supplemented by those of the residual carboxylic acid functions which have not reacted by esterification, either with the fiber or with the cyclodextrin. These carboxylic acid functions endow the fibers not only with odor absorption properties but also with cation exchange properties. On the other hand, these carboxylic acid functions endow the fibers with better affinity for water (hydrophilic nature) and improve the wettability of the treated material, in particular for materials based on slightly hydrophilic or hydrophobic fibers.

A further advantage of the process of the invention is that it is cheap, easy to carry out using equipment that is conventional in the textile industry and that it does not necessitate the use of toxic reactants.

In a preferred implementation, the solid mixture is applied by impregnating the fiber or fiber-based material with an aqueous solution of cyclodextrin(s) and/or cyclodextrin derivative(s) and/or their inclusion complexes, at least one poly(carboxylic) acid and/or at least one poly(carboxylic) acid anhydride and optionally, a catalyst, then drying the impregnated fiber or impregnated fiber-based material.

This impregnation and drying allows better incorporation of the solid reactive mixture into the fibers or causes it to penetrate it into the fibers, which subsequently facilitates both the reaction fixing the cyclodextrin to the fiber and obtaining a uniform deposit or coat of the copolymer onto the fiber or the fibers of a fiber-based material.

In a preferred variation, the fiber or fiber-based material is dried at a temperature in the range 40° C. to 150° C., preferably 110° C. or substantially 110° C. before the heating operation proper, at a temperature in the range 150° C. to 220° C.

This prior drying step is particularly recommended in the case of natural fibers such as wool or cotton, to prevent their thermal degradation.

This prior drying is advantageously carried out to obtain a solid mixture incorporated into the fiber or the fibers of the fiber-based material treated using the process of the invention, this drying being that following impregnation by an aqueous solution as described above.

Heating proper is intended to permanently fix molecules of cyclodextrin(s) to the fiber or fiber-based material, by reaction between poly(carboxylic) acid and/or poly(carboxylic) acid anhydride and the fiber or fiber-based material (chemical grafting by covalent bonding between the fiber and the molecule of cyclodextrin or cyclodextrin derivative, or the copolymer of cyclodextrin(s) and poly(carboxylic) acid(s) and/or by reaction between the poly(carboxylic) acid and the cyclodextrin and/or cyclodextrin derivative(s) to form a cross-linked copolymer (mechanical grafting by coating).

Preferably, the poly(carboxylic) acid and poly(carboxylic) acid anhydride used in the process of the invention are selected from the following poly(carboxylic) acids and poly(carboxylic) acid anhydrides: saturated and unsaturated acyclic poly(carboxylic) acids, saturated and unsaturated cyclic poly(carboxylic) acids, aromatic poly(carboxylic) acids, hydroxypoly(carboxylic) acids, preferably selected from citric acid, poly(acrylic) acid, poly(methacrylic) acid, 1,2,3,4-butanetetracarboxylic acid, maleic acid, citraconic acid, itaconic acid, 1,2,3-propane-tricarboxylic acid, aconitic acid, all-cis-1,2,3,4-cyclopentanetetracarboxylic acid, mellitic acid, oxydisuccinic acid, and thiodisuccinic acid.

Preferably, the mixture contains a catalyst selected from dihydrogen phosphates, hydrogen phosphates, phosphates, hypophosphites, alkali metal phosphites, alkali metal salts of polyphosphoric acids, carbonates, bicarbonates, acetates, borates, alkali metal hydroxides, aliphatic amines and ammonia, preferably selected from sodium hydrogen phosphate, sodium dihydrogen phosphate and sodium hypophosphite.

Preferably, the cyclodextrin is selected from α-cyclodextrin, β-cyclodextrin and γ-cyclodextrin and the cyclodextrin derivatives are selected from hydroxypropyl, methyl or acetyl derivatives of α-cyclodextrin, β-cyclodextrin and γ-cyclodextrin and inclusion complexes formed from said cyclodextrins and said cyclodextrin derivatives.

The present invention also concerns fibers or fiber-based materials preferably obtained using the process described above, which are selected from fibers or fiber-based materials that comprise a hydroxyl function and/or an amine function and which are bonded, via a covalent bond of an ester or amide type, to at least one molecule of cyclodextrin or to an inclusion complex of cyclodextrin or to a linear and/or branched and/or cross-linked compound of cyclodextrin(s) and/or cyclodextrin derivative(s) and/or to an inclusion complex with at least one poly(carboxylic) acid and wherein the structure comprises the repetition of a unit with general formula:

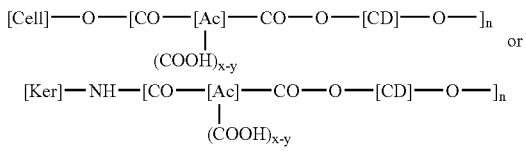

where 2<y<x−2; x^3 and n is 1 or more, and in which:

[Cell] represents the macromolecular chain of a natural or artificial cellulose fiber;

[Ker] represents the macromolecular chain of a natural or artificial protein fiber;

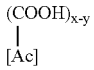

represents the molecular chain of a poly(carboxylic) acid

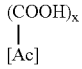

where at least two carboxylic acid functions $(COOH)_y$ have undergone esterification and/or amidation and which comprises at least one carboxylic acid function $(COOH)_{x-y}$ that has not undergone an esterification or amidation reaction; and

[CD] represents the molecular structure of α-cyclodextrin, β-cyclodextrin γ-cyclodextrin, a derivative of cyclodextrin(s), preferably a hydroxypropyl, methyl or acetyl α-cyclodextrin, β-cyclodextrin or γ-cyclodextrin derivative, or an inclusion complex of said cyclodextrins or said cyclodextrin derivatives.

The —O—CO— ester bond originates from the reaction between the hydroxyl function of the cellulose fiber and the carboxylic function of the poly(carboxylic) acid, while the amide bond —NH—CO— originates from the reaction between the amine function of the keratinous fiber and the carboxylic function of the poly(carboxylic) acid. The poly (carboxylic) acid undergoes an esterification and/or amidation reaction of at least two of its carboxylic acid functions and the cyclodextrin or cyclodextrin derivative undergoes esterification with the poly(carboxylic) acid of at least one of its hydroxyl functions.

In the case of a fiber or a fiber-based material that does not react with poly(carboxylic) acids, the fiber or material obtained by the process of the invention is simply coated with a cross-linked copolymer of cyclodextrin(s) and poly (carboxylic) acid(s). In contrast, when the fiber or fiber-based material is based on cellulose and/or keratin or comprises hydroxyl and/or amine functions, the molecules of cyclodextrin(s) are fixed to the fiber or fiber-based material in accordance with the two fixing modes described above, namely direct fixation by covalent bonding to the fiber and coating of the fiber with a cross-linked copolymer.

The present invention accommodates these two types of fibers or materials, whether or not obtained by the process of the invention. The present invention concerns fibers or fiber-based materials onto which molecules of cyclodextrin(s) and/or cyclodextrin derivative(s) are fixed only by covalent bonding, fibers or fiber-based materials onto which molecules of cyclodextrin(s) and/or cyclodextrin derivative(s) are fixed by covalent bonding and by coating the fiber or fibers of the material with a cross-linked copolymer of cyclodextrin(s), and fibers or fiber-based materials onto which cyclodextrin is fixed solely by coating with a cross-linked copolymer, without limitation to the nature or structure of said fibers or said fiber-based materials.

The materials can, for example, be knitted, woven or nonwoven textiles containing cellulose and/or keratinous fibers and/or synthetic fibers. Such fibers or fiber-based materials comprising carboxylic acid functions possess excellent odor adsorption properties and, to a lesser extent, improved water absorption properties.

DETAILED DESCRIPTION OF THE INVENTION

The present invention will be better understood from the following non-limiting examples, which better illustrate the characteristics of the process of the invention and the fibers and fiber-based materials of the present invention.

Examples 1 to 11 illustrate the process of the present invention. Examples 12 and 13 illustrate the adsorbent properties of the materials of the present invention and their possible use, in particular for the production of mosquito-proof clothing and mosquito nets.

EXAMPLE 1

5 grams (g) of a bleached cotton fabric with a weight of 100 grams/meter$^2$ (g/m$^2$) was impregnated, with the aid of a mangle, with an aqueous solution containing β-cyclodextrin (100 grams/liter (g/l)), citric acid (100 g/l) and sodium hydrogen phosphate [12-hydrate] (30 g/l). The take-up was 100%. The fabric was dried for 3 minutes at 90° C., then treated for 5 minutes at 195° C., washed with copious quantities of water and dried. The dry weight gain for the fabric was 18%.

EXAMPLE 2

5 g of a bleached cotton fabric with a weight of 100 g/m$^2$ was impregnated, with the aid of a mangle, with an aqueous solution containing β-cyclodextrin (100 g/l), citric acid (100 g/l) and sodium dihydrogen phosphate [hydrate] (30 g/l). The take-up was 100%. The fabric was dried for 3 minutes at 90° C., then treated for 3 minutes at 195° C., washed with copious quantities of water and dried. The dry weight gain for the fabric was 13%.

EXAMPLE 3

5 g of a bleached cotton fabric with a weight of 100 g/m$^2$ was impregnated, with the aid of a mangle, with an aqueous solution containing β-cyclodextrin (100 g/l), citric acid (100 g/l) and sodium hypophosphite [hydrate] (30 g/l). The take-up was 100%. The fabric was dried for 3 minutes at 90° C., then treated for 5 minutes at 195° C., washed with copious quantities of water and dried. The dry weight gain for the fabric was 12%.

EXAMPLE 4

5 g of a bleached cotton fabric with a weight of 100 g/m$^2$ was impregnated, with the aid of a mangle, with an aqueous solution containing β-cyclodextrin (100 g/l), 1,2,3,4-butanetetracarboxylic acid (100 g/l), and sodium dihydrogen phosphate [hydrate] (30 g/l). The take-up was 100%. The fabric was dried for 3 minutes at 90° C., then treated for 5 minutes at 195° C., washed with copious quantities of water and dried. The dry weight gain for the fabric was 18%.

EXAMPLE 5

5 g of a bleached cotton fabric with a weight of 100 g/m$^2$ was impregnated, with the aid of a mangle, with an aqueous solution containing β-cyclodextrin (100 g/l), polyacrylic acid (100 g/l) and sodium hypophosphite [hydrate] (30 g/l). The take-up was 100%. The fabric was dried for 3 minutes at 90° C., then treated for 5 minutes at 195° C., washed with copious quantities of water and dried. The dry weight gain for the fabric was 19%.

EXAMPLE 6

5 g of a bleached cotton fabric with a weight of 100 g/m$^2$ was impregnated, with the aid of a mangle, with an aqueous solution containing γ-cyclodextrin (150 g/l), 1,2,3,4-butanetetracarboxylic acid (100 g/l) and sodium hypophosphite [hydrate] (30 g/l). The take-up was 100%. The fabric was dried for 3 minutes at 90° C., then treated for 5 minutes at 195° C., washed with copious quantities of water and dried. The dry weight gain for the fabric was 22%.

EXAMPLE 7

5 g of a bleached cotton fabric with a weight of 100 g/m$^2$ was impregnated, with the aid of a mangle, with an aqueous solution containing α-cyclodextrin (150 g/l), polyacrylic acid (100 g/l) and sodium hypophosphite [hydrate] (30 g/l). The take-up was 100%. The fabric was dried for 3 minutes at 90° C., then treated for 5 minutes at 195° C., washed with copious quantities of water and dried. The dry weight gain for the fabric was 22%.

EXAMPLE 8

5 g of a wool fabric with a weight of 120 g/m$^2$ was impregnated, with the aid of a mangle, with an aqueous solution containing β-cyclodextrin (150 g/l), 1,2,3,4-butanetetracarboxylic acid (100 g/l), and sodium hypophosphite [hydrate] (60 g/l). The take-up was 100%. The fabric was dried for 3 minutes at 90° C., then treated for 5 minutes at 195° C., washed with copious quantities of water and dried. The dry weight gain for the fabric was 20%.

EXAMPLE 9

5 g of a hydrolyzed polyester fabric with a weight of 130 g/m$^2$ was impregnated, with the aid of a mangle, with an aqueous solution containing β-cyclodextrin (100 g/l), citric acid (100 g/l), and sodium hydrogen phosphate [12-hydrate] (30 g/l). The take-up was 90%. The fabric was dried for 3 minutes at 90° C., then treated for 5 minutes at 190° C., washed with copious quantities of water and dried. The dry weight gain for the fabric was 19%.

EXAMPLE 10

5 g of a polyester fabric with a weight of 100 g/m$^2$ was impregnated, with the aid of a mangle, with an aqueous solution containing β-cyclodextrin (100 g/l), citric acid (100 g/l), and sodium hydrogen phosphate [12-hydrate] (30 g/l). The take-up was 32%. The fabric was dried for 3 minutes at 90° C., then treated for 5 minutes at 190° C., washed with copious quantities of water and dried. The dry weight gain for the fabric was 6%.

EXAMPLE 11

5 g of a polyacrylonitrile knitted fabric with a weight of 300 g/m$^2$ was impregnated, with the aid of a mangle, with an aqueous solution containing β-cyclodextrin (100 g/l), citric acid (100 g/l) and sodium hydrogen phosphate [12-hydrate] (30 g/l). The take-up was 90%. The fabric was dried for 7 minutes at 90° C., then treated for 5 minutes at 180° C., washed with copious quantities of water and dried. The dry weight gain for the fabric was 8%.

EXAMPLE 12

This example illustrates the adsorbent properties of fabrics functionalized with β-cyclodextrin using the process of the invention. Cyclodextrins are known to be capable of forming inclusion complexes with phenolphthalein. Six samples of fabric functionalized with β-cyclodextrin using the process of the invention, with a known mass and containing different quantities of β-cyclodextrin were placed in solutions of phenolphthalein with known concentrations. The variation in the concentration of free phenolphthalein in each solution ($A_0$–$A_{96}$) was measured by visible spectroscopy at 552.4 nanometers (nm) after 96 hours. The changes in phenolphthalein concentration, expressed as the variation in the optical density per gram of functionalized fabric, are shown in the table below:

| | | | | | | |
|---|---|---|---|---|---|---|
| Weight ratio of β-cyclodextrin fixed to fabric (%) | 0 | 1.8 | 3.6 | 5.4 | 6.0 | 6.6 |
| $A_0$–$A_{96}$/g of fabric | 0.5 | 1.3 | 1.8 | 2.2 | 2.4 | 2.6 |

The ratio of cyclodextrin fixed to the textiles was measured using the difference in dry weight gain between a fabric treated with a cyclodextrin/poly(carboxylic) acid/catalyst mixture and a fabric treated with a poly(carboxylic) acid/catalyst mixture.

EXAMPLE 13

This example illustrates the use of textile materials of the invention obtained by the process of the invention as textiles with mosquito repellent properties. Diethyltoluamide (DEET) is a well known, widely used synthetic mosquito repellent. Three samples of cotton fabric with a known weight functionalized with cyclodextrins and obtained using the process of the invention using citric acid, sodium hydrogen phosphate [12-hydrate] and α-, β- and γ-cyclodextrins were placed in solutions of DEET of known concentration. Adsorption of DEET onto the textile materials was determined by measuring the change in absorbance of the initial solution at 270 nm after 96 hours. The results are shown in the table below:

| Sample | Type of cyclodextrin used for functionalization | Weight gain after functionalization (%) | $A_0$–$A_{96}$/g of fabric |
|---|---|---|---|
| 1 | α-cyclodextrin | 14 | 0.24 |
| 2 | β-cyclodextrin | 15 | 0.36 |
| 3 | γ-cyclodextrin | 15 | 0.34 |

The samples cited above were successfully tested as mosquito-repellent textiles. The repellent properties of the fabrics were evaluated after impregnation with DEET and after the following treatments: aging by exposure to air for several weeks, irradiation using a UV lamp, raising the temperature, and washing with water. In some cases, the control based on cotton not functionalized with cyclodextrin, simply impregnated with DEET and which had undergone an identical treatment, had lost 100% of its effectiveness, while the fabrics of the present invention, which had been impregnated with DEET, retained 100% of their mosquito repellent activity.

The invention claimed is:

1. A process for treating a fiber consisting of:

a. impregnating said fiber with an aqueous solution of a mixture to form an impregnated fiber, said mixture comprising 1. one or more materials from the group consisting of cyclodextrins and cyclodextrin derivatives, and 2. one or more materials selected from the group consisting of poly(carboxylic) acids and poly(carboxylic) acid anhydrides;

b. drying said impregnated fiber at a temperature in the range of 40° C. to 150° C. to obtain a treated fiber;

c. heating said treated fiber to a temperature between 150° C. and 220° C.;

d. washing said treated fiber with water; and e. drying said treated fiber.

2. A process according to claim 1, wherein the poly (carboxylic) acid and poly(carboxylic) acid anhydride are selected from the group consisting of saturated and unsaturated acyclic poly(carboxylic) acids, saturated and unsaturated cyclic poly(carboxylic) acids, aromatic poly(carboxylic) acids, hydroxy poly(carboxylic) acids, citric acid, poly(acrylic) acid, poly (methacrylic) acid, 1,2,3,4-butanetetracarboxylic acid, maleic acid, citraconic acid, itaconic acid, 1,2,3-propane-tricarboxylic acid, aconitic acid, all-cis-1,2,3,4-cyclopentanetetracarboxylic acid, mellitic acid, oxydisuccinic acid and thiodisuccinic acid.

3. A process according to claim 1, wherein the catalyst is selected from the group consisting of dihydrogen phosphates, hydrogen phosphates, hypophosphites, alkali metal phosphates, alkali metal salts of polyphosphoric acids, carbonates, bicarbonates, acetates, borates, alkali metal hydroxides, aliphatic amines and ammonia.

4. A process according to claim 1, wherein the cyclodextrin is selected from the group consisting of α-cyclodextrin, β-cyclodextrin and γ-cyclodextrin, and wherein the cyclodextrin derivatives are selected from the group consisting of hydroxypropyl, methyl or acetyl derivatives of α-cyclodextrin, β-cyclodextrin and γ-cyclodextrin.

5. The process of claim 1, wherein said fiber has been formed into a material selected from the group consisting of yarn, woven textile material, knitted textile material, non-woven textile material, paper, leather and wood fiber-based material.

6. The process of claim 1, wherein, in step (b), said impregnated fiber is dried at a temperature between 90° C. and 110° C.

7. The process of claim 1, wherein said mixture further comprises a catalyst.

* * * * *

UNITED STATES PATENT AND TRADEMARK OFFICE

CERTIFICATE OF CORRECTION

PATENT NO. : 7,048,769 B1
APPLICATION NO. : 09/913448
DATED : May 23, 2006
INVENTOR(S) : Marek Weltrowski et al.

It is certified that error appears in the above-identified patent and that said Letters Patent is hereby corrected as shown below:

Column 5, line 46, "where 2<y<x-2; xˆ3 and" should read --where 2<y<x-2; x≥3 and--; and Column 10, line 34, "phosphates, alkali" should read --phosphites, alkali--.

Signed and Sealed this

Twenty-seventh Day of November, 2007

JON W. DUDAS
*Director of the United States Patent and Trademark Office*